United States Patent [19]

Reichrt et al.

[11] 4,052,151

[45] Oct. 4, 1977

[54] ORE-PROCESSING SYSTEMS INCLUDING ROTARY KILNS

[75] Inventors: Vaclav Reichrt; Josef Smalek; Miroslav Pedlik; Miloslav Alexa, all of Prague, Czechoslovakia

[73] Assignee: Vyzkumny ustav kovu, Panenske Brezany, Czechoslovakia

[21] Appl. No.: 663,712

[22] Filed: Mar. 4, 1976

[30] Foreign Application Priority Data

Mar. 6, 1975 Czechoslovakia ..... 1503/75

[51] Int. Cl.[2] ..... F27B 7/24; F27B 7/08

[52] U.S. Cl. ..... 432/115; 110/14; 432/106; 432/112

[58] Field of Search ..... 432/106, 107, 112, 113, 432/115; 110/14

[56] References Cited

U.S. PATENT DOCUMENTS

| | | | |
|---|---|---|---|
| 560,742 | 5/1896 | Navarro | 432/113 |
| 1,178,957 | 4/1916 | Smaill | 432/113 |
| 1,690,820 | 11/1928 | Hornsey | 432/106 |
| 2,697,068 | 12/1954 | Poindexter et al. | 432/112 |
| 2,743,918 | 5/1956 | Struckmann | 432/106 |
| 3,954,391 | 5/1976 | Gottlieb | 432/14 |

*Primary Examiner*—John J. Camby

[57] ABSTRACT

A rotary kiln has a main cylindrical processing zone which is coupled downstream and upstream, respectively, to the charge-receiving and charge-withdrawal ports of the kiln through a pair of gas-tight spiral ducts. A reagent to be reacted with the charge is introduced coaxially into the main processing zone, and the spent reaction gases are coaxially removed therefrom. The reaction gas outlet conduit is provided with a hydraulic seal for maintaining a desired value of superatmospheric pressure in the main processing zone, and an additional gas conduit coaxial with the gas withdrawal conduit means is arranged to supply gaseous fuel to a plurality of heating tubes which are disposed in spaced relation through the walls of the main processing zone. Advantageously, the charge is preheated to the reaction temperature in a fluidization furnace or the like disposed upstream of the rotary kiln, and flue dust emitted from the preheating furnace is cleaned and routed into the main processing zone of the kiln along with the reagent. A rotary condenser disposed downstream of the kiln for subjecting the treated charge to an additional process step is provided with a protective atmosphere consisting of the spent reactive gases from the main processing zone of the rotary kiln, such reaction gases having first been cleaned by means of a filter located downstream of the hydraulic seal.

15 Claims, 2 Drawing Figures

ORE-PROCESSING SYSTEMS INCLUDING ROTARY KILNS

BACKGROUND OF THE INVENTION

The invention relates to processing systems for ores and the like, and more particularly to such systems employing a rotary kiln for roasting or otherwise heat-treating a charge of the ore in a controllable atmosphere having an elevated temperature and pressure. Rotary kilns which are presently employed in such systems exhibit a main cylindrical processing zone which is coupled to a charge-inlet zone and a charge-outlet zone. In order to optimize the conditions of treatment of the introduced charge in the main processing zone by a suitably established reactive atmosphere (e.g., which may be introduced directly or liberated from a solid reagent such as coal or coke), the temperature-time reaction curve of the ore treated in the processing zone must be held constant. This, in turn, requires essentially invariant atmospheric conditions within such zone.

Unfortunately, in present rotary kiln designs, the reaction atmosphere in the main processing zone cannot effectively be maintained constant because of the leakage of the reaction gas out of, and the seeping of oxygen-filled outside air into, the processing zone via the interface between such zone and the charge-introducing port of the kiln. The resulting contamination of the reaction atmosphere within the processing zone adversely affects the quality of the treated charge and severely reduces the kiln efficiency. Because of such problems, the rotary kiln cannot even be employed for certain types of heat-treatment, i.e., segregation roasting.

An additional impediment in such systems to the maintenance of a constant reactive atmosphere is the fact that the associated facilities for withdrawing the spent reactive gases from the main processing zone do not, in general, serve to maintain a desired value of superatmospheric pressure within the processing zone once such pressure is established by the zone heating.

SUMMARY OF THE INVENTION

The rotary kiln of the invention, and its associated ore-treating facilities, are arranged to avoid such disadvantages by providing facilities that maintain the operating conditions within the main processing zone of the rotary kiln essentially constant. In an illustrative embodiment, the main processing zone communicates with the respective charge-receiving and charge-withdrawal ports through a pair of spiral ducts situated coaxial with the processing zone. Charge introduced into an inlet port of the first spiral duct is advanced through the duct and into the main processing zone when the kiln is rotated, such charge completely filling the duct and preventing an outflow of reaction gases from the main processing zone through the charge-receiving port. The same phenomenon occurs downstream of the main processing zone, i.e., by the gas-tight seal formed by the charge advancing through the second spiral duct toward the charge-withdrawal port.

In order to separately maintain the established superatmospheric pressure in the main processing zone constant, the spent reaction gases are withdrawn from the main processing zone via a coaxial conduit which, once outside the rotary kiln, is coupled to an adjustable hydraulic seal, which also prevents the inflow of ambient air into the processing zone.

An additional conduit coaxial with the reaction gas withdrawal conduit extends coaxially therewith to supply gaseous fuel to a plurality of indirect heating elements for the processing zone, i.e., a plurality of spaced heating tubes which extend radially into the processing zone through an outer wall thereof.

Advantageously, the charge to be treated in the rotary kiln is preheated in a fluidization furnace and the like, which may be directly heated by a low-grade fuel. Such preheating brings the charge up to the reaction temperature, so that when such charge is advanced into the main processing zone of the kiln, the heating tubes need only establish sufficient heat to carry on the reaction of the preheated charge with a separately introduced reagent.

Such reagent, together with suitably filtered flue dust from the preheating fluidization furnace, is introduced into the interior of the main processing zone of the kiln by means of a separate conduit extending coaxial with the kiln. A rotatable worm or screw is disposed inside such reagent-introducing conduit in order to propel the reagent and the flue dust into the processing zone.

In the event that the ore treated in the kiln is subjected to a further operation in a rotary condenser, the protective atmosphere within such condenser may be supplied by means of the spent reactive gases from the main processing zone of the kiln, after passing through the hydraulic seal and a separate filter. The rotary condenser may be indirectly cooled, as by a sprinkler arrangement terminating in confronting relation to its outer surface.

Since the rotation of the kiln is effective to continually advance the charge through the processing zone via the input and output spiral ducts, and since the introduced charge is continuously treated in an invariant reactive atmosphere during its entire dwell period within the processing zone, an extremely high kiln efficiency is obtained.

BRIEF DESCRIPTION OF THE DRAWING

The invention is further set forth in the following detailed description taken in conjunction with the appended drawing, in which.

DETAILED DESCRIPTION

Figure 1:
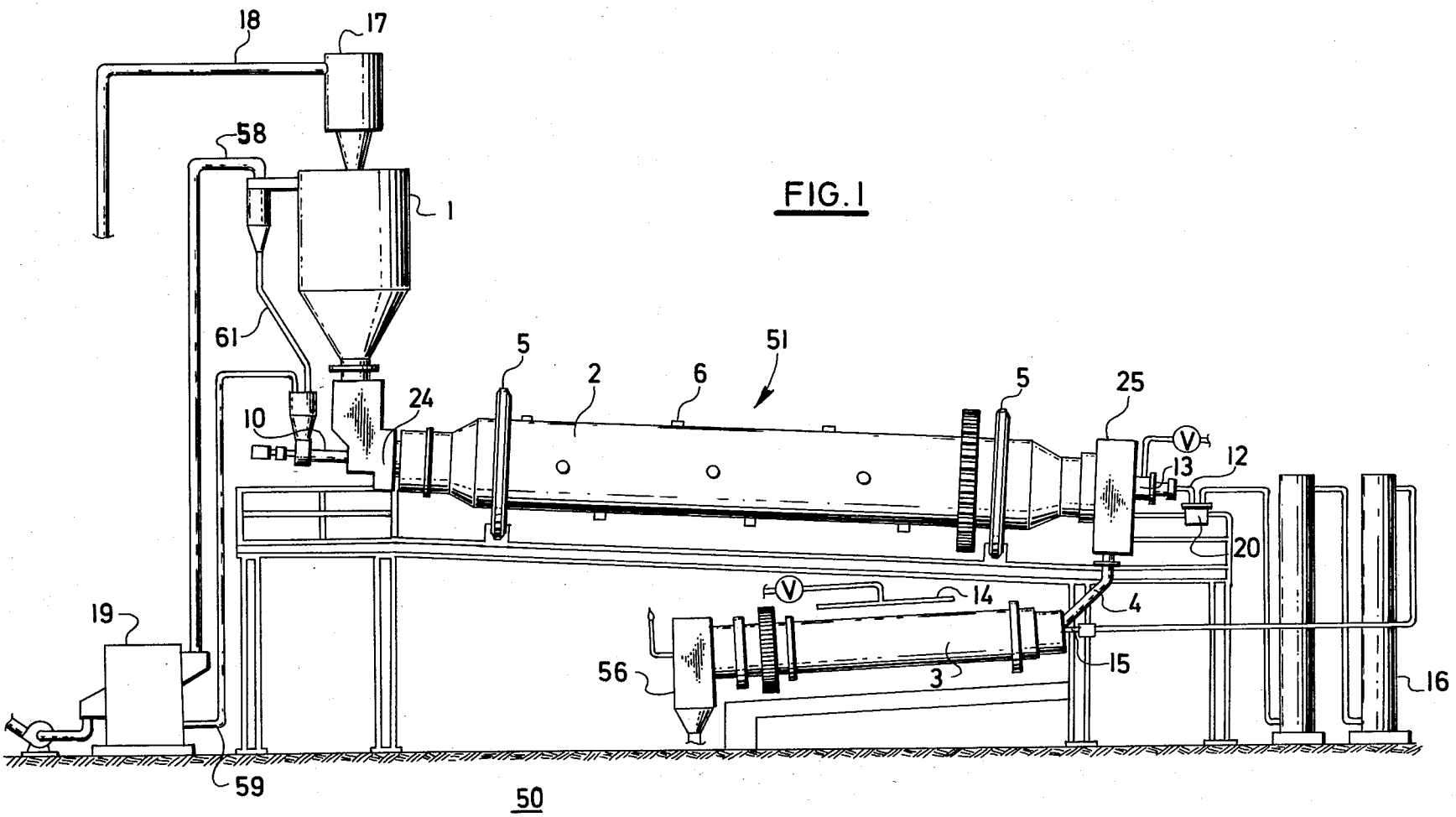
FIG. 1 is an elevation view of an ore-processing arrangement including a rotary kiln constructed in accordance with the invention.

Referring now to the drawing, an ore-processing arrangement 50 includes a rotary kiln 51 which is adapted, e.g., for the segregation roasting of nickel ores and the like. The kiln 51 includes a central cylindrical main processing zone 2, which communicates at its input end with a charge inlet zone 24 and at its output end with a charge withdrawal zone 25. The kiln is supported for rotation in a pair of rings 5, 5 by suitable means not shown about an axis which is inclined to the horizontal as viewed in the drawing.

The main processing zone 2 is adapted to accept a charge of ore from the inlet zone 24 and to react it with a suitable gas such as carbon monoxide, hydrogen, and the like in a conventional manner, such gas being illustratively released from a solid reagent such as coal or coke introduced into the main processing zone via an inlet conduit 10. The reaction takes place in the main zone 2 under conditions of elevated temperature and corresponding elevated pressure, the reaction temperature being established indirectly by means of a plurality of spaced, gas-fired heating tubes 6, 6 which individually extend into the interior of the zone 2 through an outer wall thereof. Spent reaction gases from the zone 2 are withdrawn therefrom by means of a conduit 12.

Figure 2:
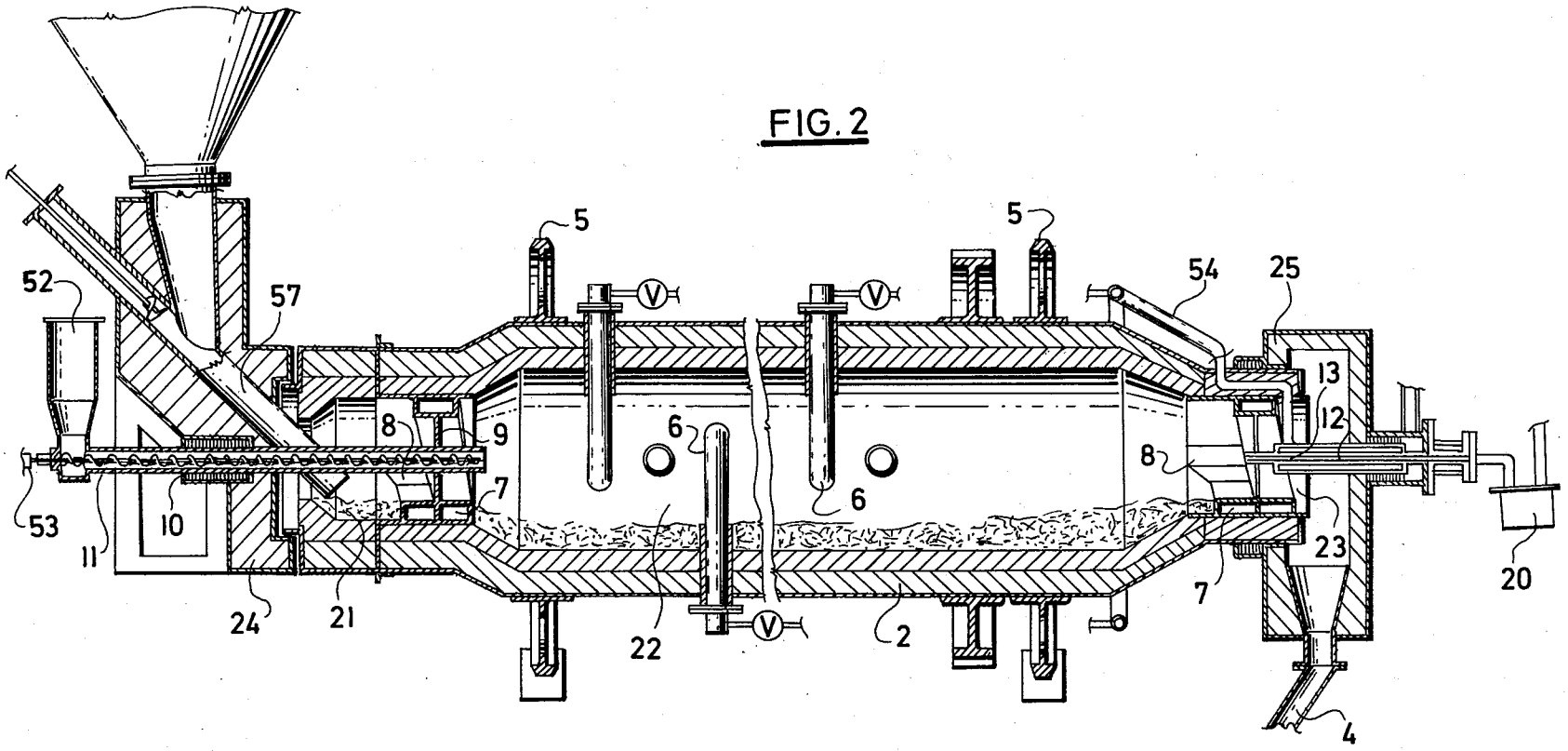
FIG. 2 is an enlarged, more detailed view, partially in section, of the rotary kiln portion of the arrangement of FIG. 1.

An illustrative embodiment of an improved form of the kiln 51 in accordance with the invention is shown in more detail in FIG. 2. The reagent feeding conduit 10 is illustrated in the form of a tube which extends coaxially through the charge inlet zone 24 and into the zone 2. An elongated worm or other screw-type structure extends axially in the tube 10 for impelling reagent forwardly from a storage bin 52, which is adapted to hold coal, coke or other suitable reagent. The screw 11 is rotatable within the tube 10 by means of a motor 53.

The withdrawal conduit 10 likewise extends downstream from the outlet end of the main processing zone 2 and through the charge-withdrawal zone 25, as shown. An additional conduit 13 extends around and coaxial with the withdrawal conduit 10 for supplying gaseous fuel to the several spaced heating tubes 6 via conduit 54.

Charge introduced into the inlet zone 24 is advanced into a funnel-shaped inlet port 8 which forms the inlet of a first gas-tight spiral duct 7, which in turn is integral with the upstream end of the main processing zone 2. In like manner, the treated charge withdrawn from the zone 2 is advanced out of the zone 2 by means of a second spiral duct 7, which in turn is integral with the downstream end of the zone 2. The charge enters the outlet spiral duct 7 by means of a second funnel-shaped port 8. The discharge end of the outlet duct 7 terminates in the charge-withdrawal zone 25, which supplies the treated chargeinto a separate processing system in the form of a rotary condenser 3 (FIG. 1) through a chute 4.

The radially inward surface of each of the ducts 7 are provided with gas-tight baffle plates 9, 9. Additionally, the inlet ports 8 and the associated ducts 7 are so arranged that charge introduced into the receiving zone 24 completely fills the interior of the inlet duct 7, so that when the charge is advanced into the interior (designated as 22) of the zone 2 as the kiln 51 is rotated, the reaction gases generated in the zone 2 cannot escape through the interior of the duct 7. In like manner, the oxygen-containing ambient air surrounding the installation cannot enter the interior of the main processing zone 2 through the now-filled inlet duct 7, thereby avoiding contamination of the interior of the zone 2 and a diminution of its operating efficiency.

A similar effect results at the outlet side of the zone 2. The treated charge withdrawn therefrom through the outlet spiral duct 7 completely fills such duct, and prevents an outflow of the reactive gases through the charge-withdrawal port 25, and likewise prevents a flow of external air in the opposite direction.

In addition, an adjustable-level hydraulic seal 20 is disposed in the spent gas-withdrawal conduit 12 outside the processing zone 2 for preventing a significant reduction of the elevated operating pressure established within the processing zone 2 because of the elevated temperature established therein. In particular, the optimum operating pressure inside the zone 2 for the particular charge being processed may be maintained relatively constant by suitably adjusting the fluid level within the hydraulic seal 20. Such seal likewise prevents an inflow of contaminating gas to the zone 2 via the conduit 12.

As shown best in FIG. 1, a filter arrangement 16 is associated with the conduit 12 downstream of the hydraulic seal 20 for removing contaminants from the spent reaction gases from the zone 2. Advantageously, the scrubbed gases from the filter 16 are conveyed to the interior of the rotary condenser 3 by means of a conduit 15 to provide a suitable protective atmosphere within such condenser 3. The condenser 3 is illustratively indirectly cooled by means of a nozzle assembly 14, which extends along and terminates adjacent an outer surface of the condenser 3.

The ore treated by the condenser 3 may be withdrawn therefrom through an outlet section 56 for suitable further processing.

The performance requirements of the heating tubes 6 may be considerably reduced by introducing the charge into the main processing zone 2 of the kiln after having been pre-heated to the reaction temperature. For this purpose, an additional directly heated furnace 1, which may be of the fluidization type, is disposed upstream of the kiln 2 and communicates therewith by means of an overflow conduit 57. The fluidization furnace 1, which advantageously may be heated by a low-grade fuel in a direct manner, receives a charge to be pre-heated from a storage bin 17, which in turn may be loaded with ore via a pneumatic transport conduit 18.

Flue dust evolving from the pre-treating operation is routed via a conduit 58 (FIG. 1) to a filter 19, and the cleaned flue dust may be added, via an additional conduit 59, to a principal coal or coke reagent which is introduced into the storage container 52, e.g., over a conduit 61.

The spiral ducts 7 may be of the single-thread variety as illustrated, or alternatively may be embodied as a double-threaded arrangement. In the latter case, a plurality of the funnel-shaped inlet ports 8 may be disposed at spaced portions of the duct periphery.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a charge processing system including a rotary kiln for heat-treating the charge in a controlled atmosphere, the kiln comprising a main cylindrical processing section in which the charge may be reacted with suitable reagents under elevated temperature and pressure, an inlet zone including a charge-receiving port disposed upstream of the main processing section, an outlet zone including a charge-withdrawal port disposed downstream of the main processing section, means for heating the interior of the main processing zone, first conduit means for introducing reagents into the main processing zone, second conduit means for withdrawing spent reaction gases from the main processing zone, and means for rotating the kiln, the improvement in which the upstream and downstream ends of the main processing section respectively comprise first and second self-contained hollow spiral ducts, the inner ends of the hollow interior of each of the first and second ducts communicating in gas-tight fashion with the interior of the main processing section, the outer ends of the hollow interior of the first and second spiral ducts individually communicating with the charge-receiving port and the charge-withdrawal port whereby charge introduced into the inlet zone enters the main processing section via the hollow interior of the first spiral duct and charge exiting from the main processing section is conducted to the outlet zone via the hollow interior of the second spiral duct, the charge passing through the hollow interior of the respective first and second spiral ducts completely filling such hollow interior to augment the gas-tight seal between the interior of the main processing section and the respective inlet and outlet zone.

2. A system as defined in claim 1, in which the second conduit means extends downstream from the main processing zone in coaxial relation to the second spiral duct.

3. A system as defined in claim 1, further comprising adjustable sealing means disposed in the second conduit means external to the main processing zone for maintaining a predetermined value of elevated pressure in the main processing zone while the elevated pressure is established therein and for preventing an inflow of contaminating gas to the main processing zone via the second conduit means.

4. A system as defined in claim 3, further comprising first filter means associated with the second conduit means downstream of the hydraulic sealing means for cleaning the spent reaction gases from the main processing zone.

5. A system as defined in claim 4, in which the system further comprises a rotary condenser having a charge inlet port in communication with the charge withdrawal port of the rotary kiln for introducing into the condenser a charge treated in the main processing zone, and third conduit means having an outlet end extending into the interior of the rotary condenser for supplying a reaction gas thereto.

6. A system as defined in claim 5, in which the system further comprises means for coupling the output of the first filter means to the inlet end of the third conduit means.

7. A system as defined in claim 5, in which the system further comprises sprinkler means terminating in confronting relation to the outer surface of the rotary condenser for selectively spraying the outer surface with a cooling liquid.

8. A system as defined in claim 1, in which the system further comprises a preheating furnace disposed upstream of the rotary kiln, means for coupling charge to the furnace to be preheated thereby to the reaction temperature of the main processing zone of the rotary kiln, and means for coupling the preheated charge from the furnace to the charge-receiving port of the rotary kiln.

9. A system as defined in claim 8, in which the system further comprises third conduit means for withdrawing flue dust from the furnace, filter means for cleaning the withdrawn flue dust, and fourth conduit means coupled to the filter means for conveying cleaned flue dust to the input of the first conduit means, whereby the cleaned flue dust can be introduced into the main processing zone with the reagent.

10. A system as defined in claim 1, in which the first conduit means extends upstream from the main processing zone coaxial with the first spiral duct.

11. A system as defined in claim 10 in which the system further comprises an elongated rotatable screw disposed in the first conduit means for impelling reagent and flue dust into the main processing zone.

12. A system as defined in claim 1, in which the outer ends of the respective first and second spiral ducts are funnel-shaped.

13. A system as defined in claim 1, in which the system further comprises baffle plate means for sealing the radial inner surfaces of each of the first and second spiral ducts.

14. In a charge processing system including a rotary kiln for heat-treating the charge in a controlled atmosphere, the kiln comprising a main cylindrical processing section in which the charge may be reacted with suitable reagents under elevated temperature and pressure, an inlet zone including a charge-receiving port disposed upstream of the main processing section, an outlet zone including a charge-withdrawal port disposed downstream of the main processing section, a plurality of mutually spaced gas-fired heating tubes individually projecting radially into the main processing zone, first conduit means for introducing reagents into the main processing zone, second conduit means for withdrawing spent reaction gases from the main processing section, a first spiral duct integral with the upstream end of the main processing zone and having a hollow interior through which charge may be advanced into the main processing section from the charge-receiving port when the kiln is rotated, a second spiral duct integral with the downstream end of the main processing section and having a hollow interior through which treated charge may be advanced out of the main processing section to the charge-discharge port when the kiln is rotated, and means for rotating the kiln.

15. A system as defined in claim 14, in which the second conduit means extends downstream from the main processing zone coaxial with the second spiral duct, and in which the system further comprises third conduit means extending coaxial with the second conduit means for supplying gas to the heating tubes.

* * * * *